US006925152B2

(12) United States Patent
Steinlage et al.

(10) Patent No.: US 6,925,152 B2
(45) Date of Patent: Aug. 2, 2005

(54) TARGET ATTACHMENT ASSEMBLY

(75) Inventors: Gregory Alan Steinlage, Milwaukee, WI (US); Liqin Wang, Brookfield, WI (US)

(73) Assignee: GE Medical Systems Global Technology Co., LLC, Wauskesha, WI (US)

( * ) Notice: Subject to any disclaimer, the term of this patent is extended or adjusted under 35 U.S.C. 154(b) by 114 days.

(21) Appl. No.: 10/249,857

(22) Filed: May 13, 2003

(65) Prior Publication Data

US 2004/0228446 A1 Nov. 18, 2004

(51) Int. Cl.[7] ..... H01J 35/10; H01J 35/26
(52) U.S. Cl. ..... 378/144; 378/125; 378/128
(58) Field of Search ..... 378/125, 127, 378/128, 132, 144

(56) References Cited

U.S. PATENT DOCUMENTS 4,670,895 A * 6/1987 Penato et al. ..... 378/125
4,736,400 A * 4/1988 Koller et al. ..... 378/125
6,088,426 A * 7/2000 Miller ..... 378/144
6,173,996 B1 * 1/2001 Derakhshan et al. ..... 285/114
6,212,753 B1 * 4/2001 Derakhshan et al. ..... 29/447
6,735,281 B2 * 5/2004 Higgins et al. ..... 378/132

* cited by examiner

*Primary Examiner*—Allen C. Ho
(74) *Attorney, Agent, or Firm*—Peter Vogel, Esq.

(57) ABSTRACT

An x-ray tube target assembly 16 is provided. The assembly 16 includes a target disc element 18 having a target bore 22. A target shaft 20 transmits rotational drive to the target disc element 18. The target shaft 20 includes a plurality of axial adjustment slots 30 formed in an upper portion. The plurality of axial adjustment slots 30 are positioned around the target shaft 20 to form a plurality of partial circumferential ribs 36. The plurality of partial circumferential ribs 36 are brazed to the target bore 22.

17 Claims, 1 Drawing Sheet

TARGET ATTACHMENT ASSEMBLY

BACKGROUND OF INVENTION

The present invention relates generally to an x-ray tube target assembly, and, more particularly to a graphite target assembly with improved mechanical joints.

X-ray tubes are well known and widely utilized in a variety of medical imaging fields, medical therapy fields, and material testing and analysis industries. They are commonly comprised of both an anode assembly and a cathode assembly. X-rays are produced when electrons are released in a vacuum with the tube, accelerated and then abruptly stopped. The electrons are released from a heated filament. A high voltage between the anode and the accelerates the electrons and causes them to impinge on the anode. The anode is also referred to as the target since the electrons impact the anode at the focal spot.

In order to dissipate the heat generated at the focal spot, X-ray tubes often incorporate a rotating anode structure. The anode in these arrangements commonly comprises a rotating disc so that the electron beam constantly strikes a different point on the target surface. Although these methods can reduce the concentration of heat at a single spot on the target surface, there is still considerable heat generated within the target. The rotating disc and rotating shaft assembly may, therefore, be exposed to high temperatures in addition to significant temperature fluctuations between operational states. These temperature fluctuations can expose the components of a target assembly as well as their attachment means to considerable expansion induced stresses.

Such is often the case with graphite and graphite composite target assemblies. The joints between the elements of the target assemblies are often exposed to significant tension loading during cooling after operation. This can cause the fracture or weakening of joint assemblies. This joint stress phenomenon can be even further exacerbated by the use of materials, such as the mentioned graphite composites, with differing coefficients of thermal expansion (CTE). When these materials with CTE mismatches are joined, the heating and cooling phases of the target assembly can induce significant stresses on the joints. Many existing arrangements are forced to rely solely on mechanical joints in order to avoid joint destruction as a result of these stresses. Mechanical joints, however, must be formed with tight tolerances and their associated costs, can require complex machining operations, and are themselves susceptible to stresses resulting from differing cooling/heating rates. Alternatives to conventional welding processes, such as inertia welding (I-welding), are often required as welding cannot often be utilized in cases of large CTE mismatch, the use of graphite materials, non-weldable material combinations, brittle or extremely hard materials, and where significant work has made the material unweldable.

Thus, present target assemblies often do not provide attachment methodologies suitable for exposure to the CTE mismatch or the temperature fluctuations normally experienced by x-ray tube target assemblies. Furthermore, present target assemblies often require overly expensive tooling and manufacturing methodologies. It would, therefore, be highly desirable to have a target assembly with an improved design such that robust mechanical joints were present between target disc members and target shaft members.

SUMMARY OF INVENTION

An x-ray tube target assembly is provided. The assembly includes a target disc element having a target bore. A target shaft transmits rotational drive to the target disc element.

The target shaft includes a plurality of axial adjustment slots formed in an upper portion. The plurality of axial adjustment slots are positioned around the target shaft to form a plurality of partial circumferential ribs. The plurality of partial circumferential ribs are brazed to the target bore. Other features of the present invention will become apparent when viewed in light of the detailed description of the preferred embodiment when taken in conjunction with the attached drawings and appended claims.

DETAILED DESCRIPTION

Figure 1:
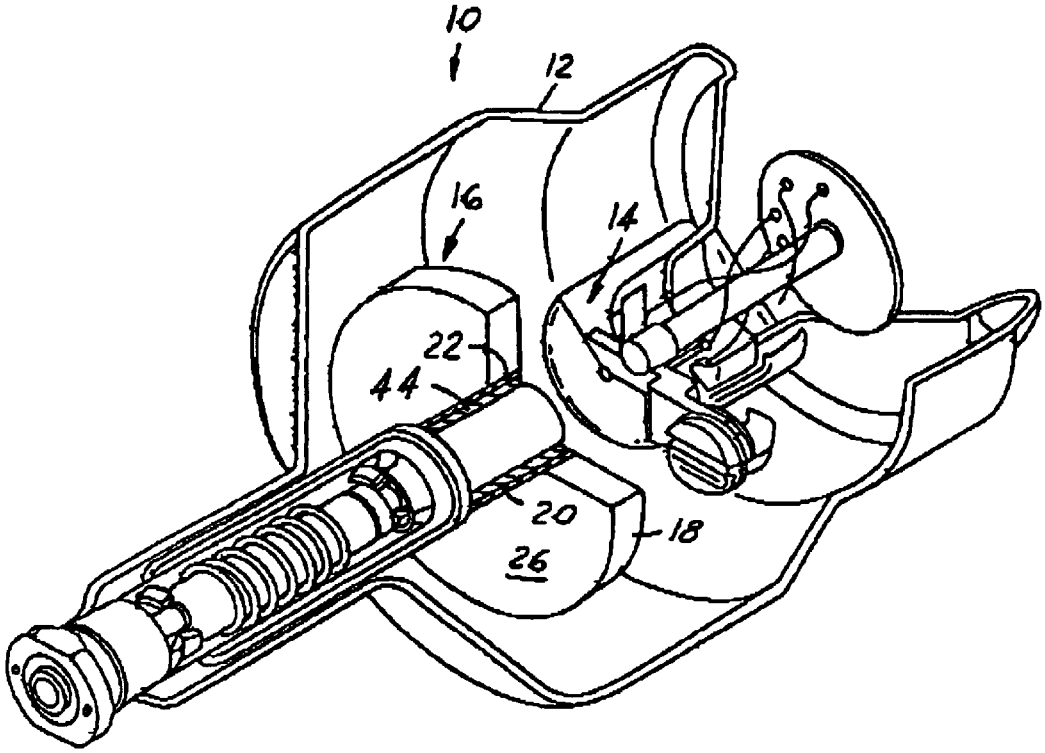
FIG. 1 is an illustration of an x-ray tube in accordance with the present invention.

Referring now to FIG. 1, which is an illustration of an x-ray tube assembly 10 in accordance with the present invention. Although a specific x-ray tube assembly 10 is illustrated, it should be understood that the present invention is contemplated to be useful in a wide variety of x-ray tube assemblies. The x-ray tube assembly 10 includes an x-ray tube housing 12. Within the x-ray tube housing 12 resides a cathode 14. The cathode 14, when charged with an electric current, emits electrons. This electrons travel within the x-ray tube assembly 10 until they impact the anode/x-ray tube target assembly 16. Upon impacting the x-ray tube target assembly 16, the electrons generate x-rays. Such x-ray tube operation is well known in the art.

It is also known, however, that excessive heat can generate in the target disc element 18 if the electrons continuously impact a single spot. The target assembly 16, therefore includes a target shaft 20 positioned in and in communication with the target bore 22 of the target disc element 18. In this fashion, the target shaft 20 can be utilized to spin the target disc element 18 such that the electron stream from the cathode 14 continuously impacts different places on the impact surface 24 of the target disc element 18. Although the rotation of the target disc element 18 reduces localized temperature extremes, the target disc element 18 still experiences significant temperature fluctuations. This can induce undesirable stresses where the target shaft 20 attaches to the target bore 22. Relatively inflexible mounting techniques, such as a first braze 23 (see FIG. 3) may experience undesirable tensile stresses leading to reduced durability.

These stresses can be further exaggerated where the target disc element 18 is comprised of a first coefficient of thermal expansion material 26 and the target shaft 20 is comprised of a second coefficient of thermal expansion material 28. When the coefficient of thermal expansion (CTE) is varied between the target disc element 18 and the target shaft 20 they will expand/contract in response to thermal energy at different rates. This can place an increased stress on any methodology utilized to mount the target shaft 20 to the target bore 22, such as the first braze 23. Using other mounting methodologies such as interference fit, the CTE mismatch can affect mounting integrity. It is contemplated that the target disc element 18 can be formed from a variety of materials including, but not limited to, graphite, TZM (alloys of molybdenum with titanium and zirconium added in small quantities), and C—C composite (high strength carbon fiber and carbon matrix material). The target shaft 20 may similarly be formed from a wide variety of materials. It is contemplated, however, that the target shaft 20 may be formed from a material with a higher CTE than the target disc element 18. In this circumstance, the CTE mismatch between the first coefficient of thermal expansion material 26 and the second coefficient of thermal expansion material 28 can result in undesirable stresses in the first braze 23.

Figure 2:
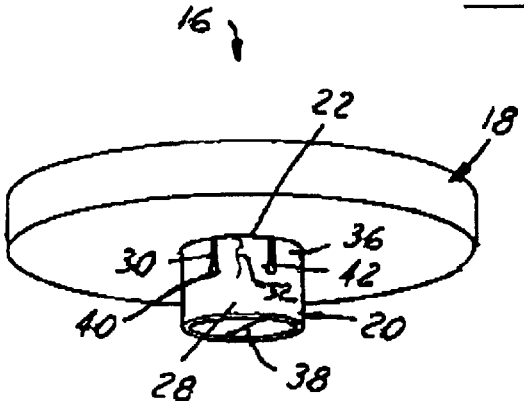
FIG. 2 is an illustration of an embodiment of an x-ray tube assembly in accordance with the present invention, the x-ray tube assembly for use in the x-ray tube illustrated in FIG. 1.

The present invention addresses the challenge presented by CTE mismatch through a novel design illustrated in FIG. 2. The target shaft 20 can include a plurality of axial adjustment slots 30 formed in the upper portion 32 of the target shaft 20. Although these axial adjustment slots 30 may be formed in a variety of fashions, in one embodiment it is contemplated that the axial adjustment slots 30 penetrate the upper surface 34 (see FIG. 3) of the target shaft 20 such that a plurality of partial circumferential ribs 36 are formed into the upper portion 32 of the target shaft 20. This allows the shaft diameter 38 to be adjustable where it is mounted to the target bore 22. In this fashion, the shaft diameter 38 can flex naturally with the target bore 22 under various thermal loadings without unduly stressing the first braze 23 or other attachment method. Although the number and position of the plurality of axial adjustment slots 30 may be varied, it is preferable that the plurality of axial adjustment slots 30 be evenly spaced around the target shaft 20. In addition, the target shaft 20 can include a plurality of circular bores 40 each positioned on a lower end 42 of one of the plurality of axial adjustment slots 30. These circular bores 40 serve not only to increase the flexibility of the shaft diameter 38, but prevent cracks or creep from arising within the target shaft 20 during operation. Although the dimensional characteristics of the axial adjustment slots 30 and circular bores 40 can be modified to control the allowable flexibility of the shaft diameter 38 while retaining target shaft 20 integrity, they preferably extend downwards below the target bore 22.

Figure 3:
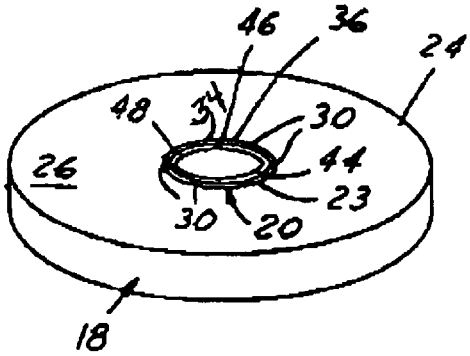
FIG. 3 is a detail illustration of an alternate embodiment of an x-ray tube assembly in accordance with the present invention, the x-ray tube assembly for use in the x-ray tube illustrated in FIG. 1.

The present invention can further utilize an additional approach to reducing stresses in the target shaft 20/target bore 22 mount. This additional approach is illustrated in FIG. 3. The present invention can further include an inner disc 44 positioned within and mounted to the target shaft 20. The inner disc 44 can be mounted to the target shaft 20 in a variety of fashions. Although the term "disc" has been utilized in regards to the inner disc 44, it should be understood that the term "disc" is intended to encompass both solid discs as well as rings or other similar structures. The illustrated inner disc 44, in fact, is illustrated in FIGS. 1 and 3 as a ring type disc. In other embodiments, however, it is contemplated that the inner disc 44 may have either a single hole (ring) or multiple wholes that may either fully penetrate the inner disc 44 or only partially penetrate the inner disc 44.

One embodiment contemplates the use of a second braze 46 to attach the inner disc 44 to the plurality of partial circumferential ribs 36. Although a variety of first braze 23 and second braze 46 combinations are contemplated, one embodiment contemplates the first braze 23 having a solidification temperature approximately equal to the second braze 46. The inner disc 44 can be comprised of a wide variety of materials. The inner disc 44 is preferably comprised of a third coefficient of thermal expansion material 48 designed to minimized the strain experienced by the first braze 23. In one embodiment this third coefficient of thermal expansion material 48 can have an identical CTE as the first coefficient of thermal expansion material 26. The Inner disc 44 provides support to the target shaft 20 and the first braze 23 such that stresses are minimized during thermal expansion or contraction. In this light, the inner disc 44 may be utilized with or without the use of axial adjustment slots 30 in the target shaft 20. The present invention, therefore, presents a robust solution to target shaft 20 to target disc element 18 mounting that is tolerant of CTE mismatch often present in desired material construction choices.

While particular embodiments of the invention have been shown and described, numerous variations and alternative embodiments will occur to those skilled in the arm. Accordingly, it is intended that the invention be limited only in terms of the appended claims.

What is claimed is:

1. An x-ray tube target assembly comprising:

a target disc element having a target bore;

a target shaft positioned within and in communication with said target bore, said target shaft transmitting rotational drive to said target disc element; and a plurality of axial adjustment slots formed in an upper portion of said target shaft, said plurality of axial adjustment slots forming a plurality of partial circumferential ribs, said plurality of partial circumferential ribs mounted to said target bore; and an inner disc positioned within said target shaft, said inner disc mounted to said plurality of partial circumferential ribs.

2. An x-ray tube target assembly as described in claim 1, wherein said inner disc is brazed to said plurality of partial circumferential ribs using a second braze, and said plurality of partial circumferential ribs are brazed to said target bore using a first braze.

3. An x-ray tube target assembly as described in claim 2, wherein said first braze has a solidification temperature equal to said second braze.

4. An x-ray tube target assembly as described in claim 1, wherein said inner disc is comprised of a third coefficient of thermal expansion material.

5. An x-ray tube target assembly as described in claim 1, wherein said target disc element is comprised of a first coefficient of thermal expansion material, said target shaft is formed from a second coefficient of thermal expansion material, said inner disc is comprised of said first coefficient of thermal expansion material.

6. An x-ray tube target assembly comprising:

a target disc element having a target bore, said target disc comprised of a first coefficient of thermal expansion material;

a target shaft positioned within and in brazed to said target bore using a first braze, said target shaft comprised of a second coefficient of thermal expansion material; and an inner disc positioned within said target shaft, said inner disc brazed to said target shaft using a second braze.

7. An x-ray tube target assembly as described in claim 6, wherein said inner disc is comprised of a third coefficient of thermal expansion material.

8. An x-ray tube target assembly as described in claim 6, wherein said inner disc is comprised of said first coefficient of thermal expansion material.

9. An x-ray tube target assembly as described in claim 6, wherein said first braze has a solidification temperature equal to said second braze.

10. An x-ray tube target assembly as described in claim 6, further comprising:

a plurality of axial adjustment slots formed in an upper portion of said target shaft, said plurality of axial adjustment slots forming a plurality of partial circumferential ribs, said plurality of partial circumferential ribs brazed to said target bore using said first braze.

11. An x-ray tube target assembly as described in claim 10, wherein said plurality of axial adjustment slots are positioned evenly around said target shaft.

12. An x-ray tube target assembly as described in claim 10, further comprising:

a plurality of circular bores each positioned on a lower end of one of said plurality of axial adjustment slots.

13. An x-ray tube target assembly as described in claim 6, wherein said second coefficient of thermal expansion material has a higher coefficient of thermal expansion than said first coefficient of thermal expansion material.

14. A method of attaching target disc element comprised of a first coefficient of thermal expansion material to a target shaft comprised of a second coefficient of thermal expansion, comprising:

forming a plurality of axial adjustment slots in an upper portion of the target shaft, said plurality of axial adjustment slots forming a plurality of partial circumferential ribs; and brazing said plurality of partial circumferential ribs to a target bore of the target disc element using a first braze.

15. A method as described in claim 14, further comprising:

placing an inner disc within the target shaft; and brazing said inner disc to said plurality of partial circumferential ribs using a second braze.

16. A method as described in claim 14, wherein said inner disc comprises a third coefficient of thermal expansion material.

17. A method as described in claim 14, wherein said first braze has a solidification temperature equal to said second braze.

* * * * *